US008272165B2

(12) United States Patent
Tomioka

(10) Patent No.: US 8,272,165 B2
(45) Date of Patent: Sep. 25, 2012

(54) ASSIST DEVICE FOR MOVABLE BODY

(75) Inventor: Kazuyuki Tomioka, Kanagawa (JP)

(73) Assignee: Nifco Inc., Yokohama-Shi (JP)

( * ) Notice: Subject to any disclaimer, the term of this patent is extended or adjusted under 35 U.S.C. 154(b) by 300 days.

(21) Appl. No.: 12/733,973

(22) PCT Filed: Oct. 1, 2008

(86) PCT No.: PCT/JP2008/067857

§ 371 (c)(1),
(2), (4) Date: Apr. 29, 2010

(87) PCT Pub. No.: WO2009/044783

PCT Pub. Date: Apr. 9, 2009

(65) Prior Publication Data

US 2010/0229341 A1 Sep. 16, 2010

(30) Foreign Application Priority Data

Oct. 2, 2007 (JP) ..... 2007-258647

(51) Int. Cl.
*E05F 11/00* (2006.01)

(52) U.S. Cl. ..... 49/275; 49/364; 49/379

(58) Field of Classification Search ..... 49/275, 49/364, 360, 379; 16/49
See application file for complete search history.

(56) References Cited

U.S. PATENT DOCUMENTS 3,771,823 A * 11/1973 Schnarr ..... 292/270
5,044,680 A * 9/1991 Baker et al. ..... 292/278
5,072,973 A * 12/1991 Gudgel et al. ..... 292/55
5,551,187 A * 9/1996 Brouwer et al. ..... 49/1
5,901,992 A * 5/1999 Winkler ..... 292/270
2007/0186481 A1 8/2007 Tomita et al.

FOREIGN PATENT DOCUMENTS

| | | | |
|---|---|---|---|
| JP | 2004-052454 | A | 2/2004 |
| JP | 2005-34348 | A | 2/2005 |
| JP | 2005-127527 | A | 5/2005 |
| JP | 2006-169723 | A | 6/2006 |
| JP | 2006-200301 | A | 8/2006 |
| JP | 2007-107211 | A | 4/2007 |
| JP | 2007-177459 | A | 7/2007 |
| JP | 2007-255018 | A | 10/2007 |

* cited by examiner

*Primary Examiner* — Jerry Redman
(74) *Attorney, Agent, or Firm* — Manabu Kanesaka

(57) ABSTRACT

A catcher member is provided to be movable between a standby position and a retracted position, and at the standby position, while being urged by an urging device, the catcher member is positioned in the standby position by a holding device. When a movable body is moved forward a predetermined movement position, a striker member is caught and engaged with the catcher member positioned in the standby position, and subsequently, holding by the holding device is released, and the catcher member is moved or relatively moved up to the retracted position by being urged by the urging device, so that the urging force is applied to the movable body up to position where the movement ends. An operation device is provided so as to be able to operate to move the catcher member which was moved to the retracted position without catching the striker member, toward the standby position.

8 Claims, 18 Drawing Sheets

ASSIST DEVICE FOR MOVABLE BODY

FIELD OF TECHNOLOGY

This invention relates to an improvement in a mechanism for assisting at least the forward movement of a movable body supported by a stationary body up to a position where the movement ends from a predetermined movement position, by urging means.

BACKGROUND ART

When a door is closed, there is a mechanism according to Japanese Patent Application No. 2006-332237 in which the present applicant previously disclosed as the mechanism assisting the pivoting of the door up to the position where the door is completely closed from a predetermined rotational position by the urging means.

Also, when a sliding door is closed, there is a mechanism according to Japanese Patent Application No. 2007-101629 in which the present applicant previously disclosed a mechanism for assisting the movement of the sliding door up to the position where the sliding door is completely closed from the predetermined movement position by the urging means.

The mechanism according to Japanese Patent Application No. 2006-332237 includes a striker member provided in the door as the movable body, and a catcher member provided in a door frame as the stationary body.

The mechanism according to Japanese Patent Application No. 2007-101629 includes the striker member provided in the door frame as the stationary body, and the catcher member provided in the sliding door as the movable body.

In either mechanism, the catcher member is provided so as to be movable between a standby position and a retracted position, and at the standby position, the catcher member is positioned in the standby position by holding means while being urged by the urging means. Then, when the movable body is moved forward to a predetermined movement (or rotational) position, the striker member is caught and engaged with the catcher member positioned in the standby position, and subsequently, holding by the holding means is released to allow the catcher member to move or relatively move up to the retracted position by being urged by the urging means. This causes the urging force to be applied to the movable body up to the position where the movement ends.

Here, in these mechanisms, if the holding of the catcher member by the holding means is inadvertently released from a state wherein the movable body is not moved forward to the predetermined movement position, the catcher member may move to the retracted position without catching the striker member due to the urging. In such case, a return to a desired state is attempted to be carried out by moving the movable body up to the position where the movement ends, and allowing the catcher member which is in the retracted position to catch and engage the striker member. Therefore, in a case wherein an assembled or combined state of the movable body relative to the stationary body was damaged for some reason, for example, in a case such that the door frame as the stationary body or the door as the movable body had a deviation and the like, even if the movable body is moved up to the position where the movement ends, the striker member cannot enter into an engaging portion of the catcher member which is in the retracted position.

DISCLOSURE OF THE INVENTION

Problems to be Solved by the Invention

The main problem which this invention is directed to solving is to make it possible to easily and reliably carry out a return to the desired state in the case that the holding of the catcher member by the holding means is inadvertently released as mentioned above in this kind of mechanism, even in such case that the assembled or combined state of the movable body relative to the stationary body was damaged for some reason.

Means for Solving the Problems

In order to solve said problem, in this invention, an assist device for a movable body comprises the following structures (1) to (5).

(1) The assist device for the movable body assisting at least the forward movement of the movable body supported by a stationary body up to a position where the movement ends from a predetermined movement position by urging means, and (2) including a striker member provided in either one of the stationary body or the movable body, and a catcher member provided in the other one of same, (3) wherein the catcher member is provided so as to be movable between a standby position and a retracted position, and also at the standby position, the catcher member is positioned in the standby position by holding means while being urged by urging means, and (4) when the movable body is moved forward to a predetermined movement position, the striker member is caught and engaged with the catcher member which is positioned in the standby position, and subsequently, the holding by the holding means is released to allow the catcher member to move or relatively move up to the retracted position by being urged by the urging means, and this causes the urging force to be applied to the movable body up to the position where the movement ends, and (5) furthermore, the assist device for the movable body comprises operation means allowing the catcher member, which was moved to the retracted position without catching the striker member to operate, to move toward the standby position.

If the holding of the catcher member by the holding means is inadvertently released from a state wherein the movable body is not moved forward to the predetermined movement position, the catcher member may move to the retracted position while not catching the striker member due to the urging. In such case, a return to a desired state is attempted to be carried out by moving the movable body up to the position where the movement ends and catching and engaging the striker member with the catcher member which is in the retracted position. However, in a case wherein an assembled or combined state of the movable body relative to the stationary body was damaged for some reason, for example, in a case such that the door frame as the stationary body or the door as the movable body had an deviation and the like, even if the movable body is moved up to the position where the movement ends, the striker member cannot enter into an engaging portion of the catcher member which is in the retracted position. In the assist device according to this invention, even in such case, the striker member can be caught and engaged with the catcher member by moving the catcher member toward the standby position for a dimension of the deviation as mentioned above by the operation means.

The striker member is constituted by a striker base and a striker axis projecting from the striker base so as to be retractable by being urged. The catcher member is constituted as a pivotal body, and also comprises an engaging recess of the striker axis which is open in the outer circumference and continues toward the pivot center side. When the movable body is moved forward to the predetermined movement position, the striker axis is entered into the engaging recess of the catcher member which is in the standby position, and due to the subsequent urging of the urging means, the catcher member is pivoted to the retracted position, so that the urging force is applied to the movable body up to the position where the movement ends. Also, in a state wherein the catcher member is moved to the retracted position without catching the striker member, the forward movement of the movable body toward the position where the movement ends may be allowed due to the retraction of the striker axis against the urging accompanied with the abutting against a lateral portion of the engaging recess in the striker member.

In the case wherein the catcher member is moved to the retracted position without catching the striker member, if the movable body is moved forward up to the position where the movement ends, the striker axis hits the lateral portion of the engaging recess in the striker member, and the striker axis retracts once against the urging, so that the lateral portion of a projecting end of the striker axis can cross over. Then, after this crossing over, due to the urging, the striker axis projects again, is entered into the engaging recess of the catcher member which is in the retracted position, and is caught and engaged. In the case wherein the assembled or combined state of the door as the movable body relative to the door frame as the stationary body had a deviation or the like, even if the door is moved up to the position where the movement ends, the striker axis of the striker member cannot enter into the engaging recess of the catcher member which is in the retracted position. In such assist device, even in such case, due to the operation means, the catcher member can be pivoted toward the standby position for the dimension of the deviation or the like up to the position where the striker axis of the striker member enters into the engaging recess of the catcher member.

Effect of the Invention

According to the assist device of this invention, it is possible to easily and reliably carry out the return to the desired state in the case that the holding of the catcher member by the holding means is inadvertently released as mentioned above even in such case that the assembled or combined state of the movable body relative to the stationary body was damaged for some reason.

BEST MODES OF CARRYING OUT THE INVENTION

Hereinafter, best modes for conducting this invention are explained based on FIG. 1 to FIG. 20.

Figure 1:
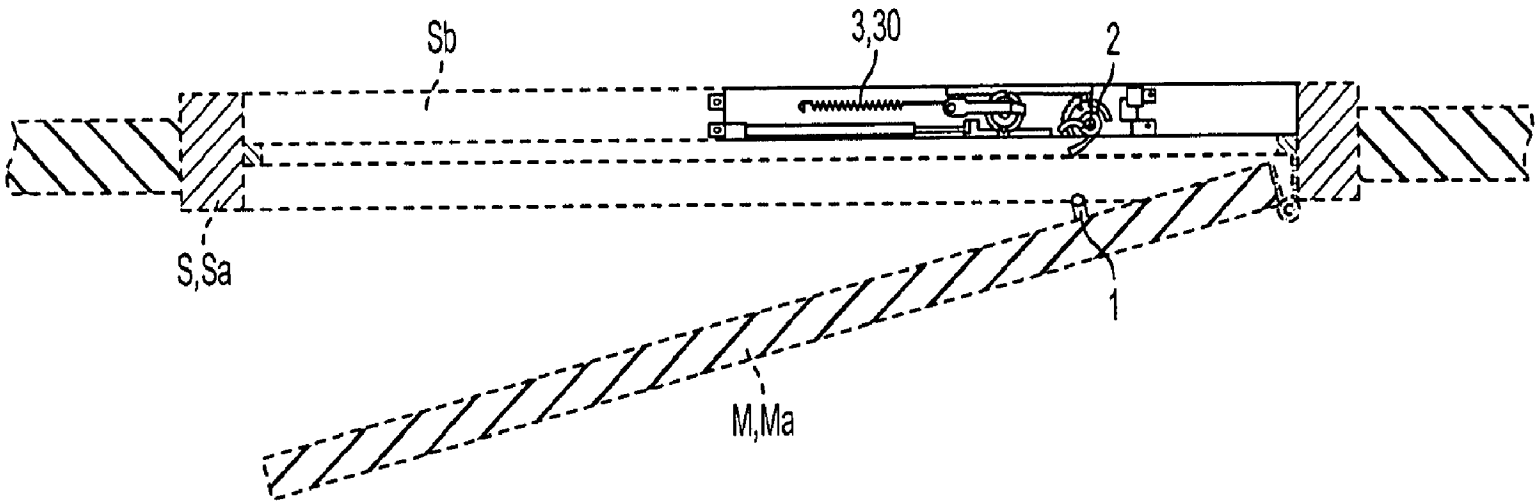
FIG. 1 is an explanatory bottom view showing a use state in a case wherein an assist device, according to an embodiment of the present invention, is used with a door.
Figure 2:
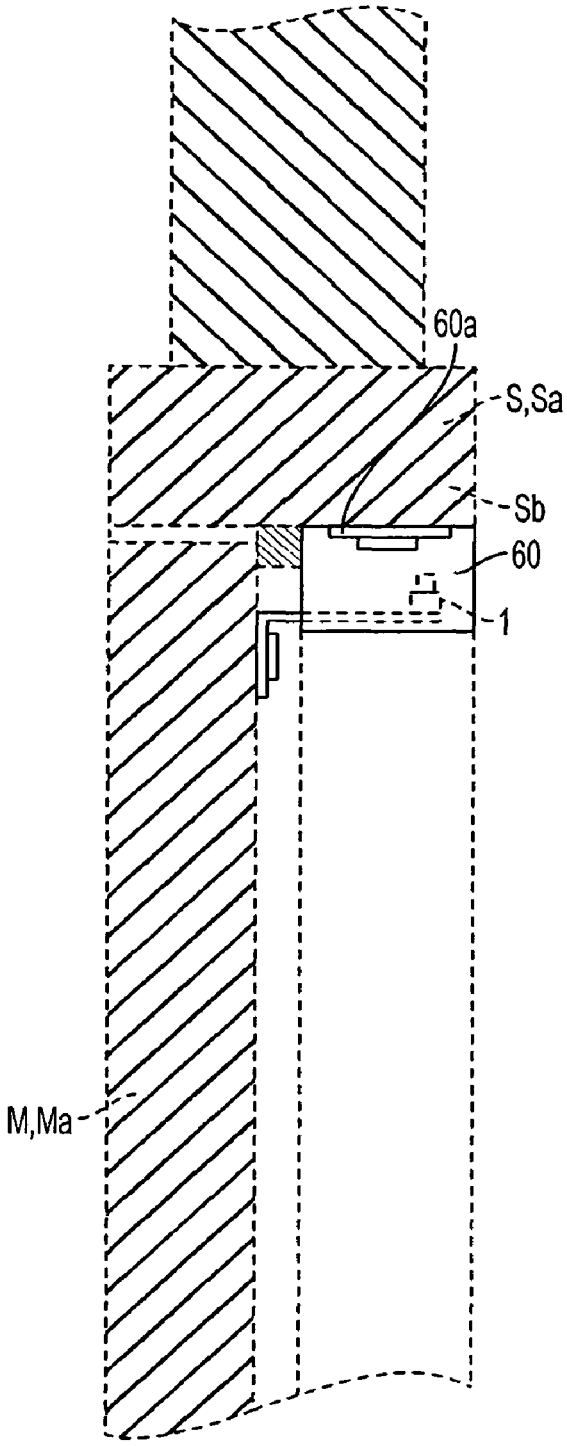
FIG. 2 is an explanatory side view of the same.
Figure 3:
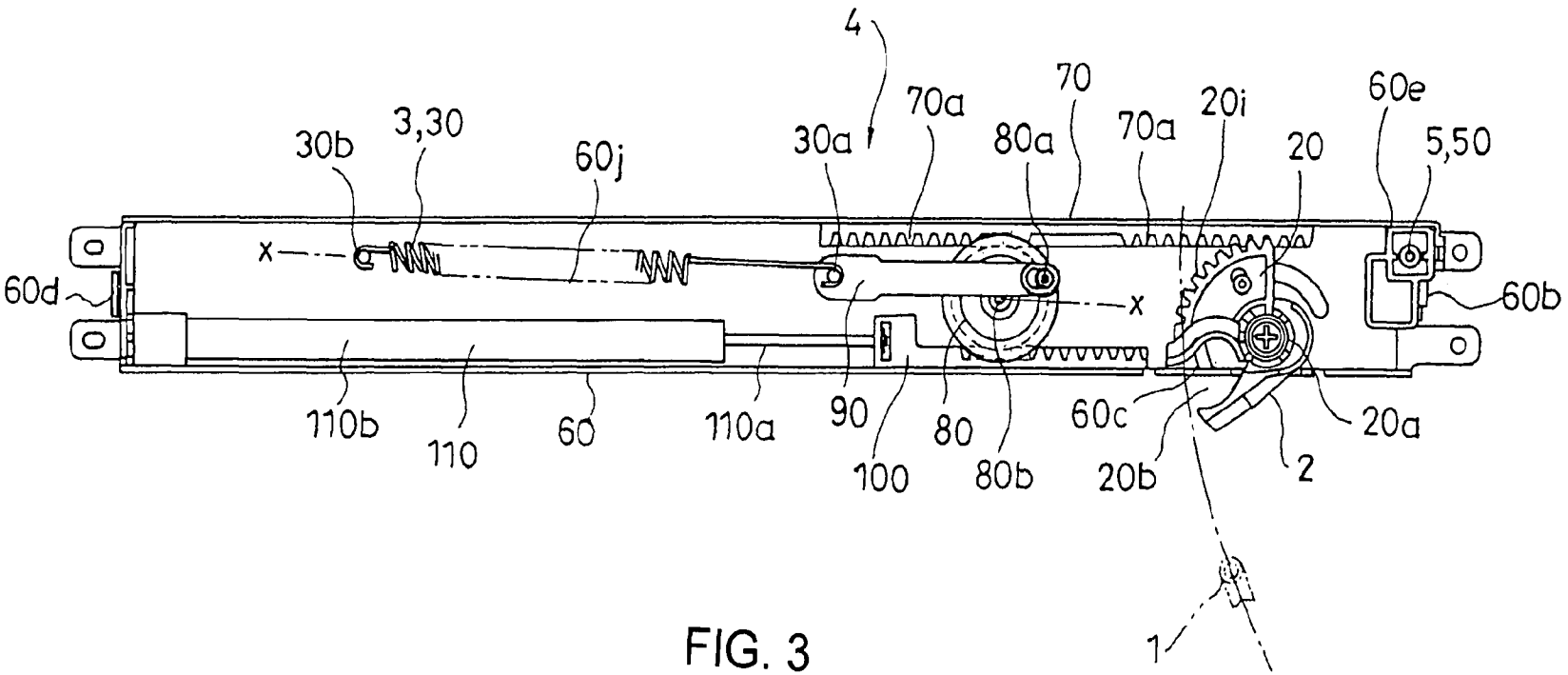
FIG. 3 is a bottom view of essential parts of the same assist device.
Figure 4:
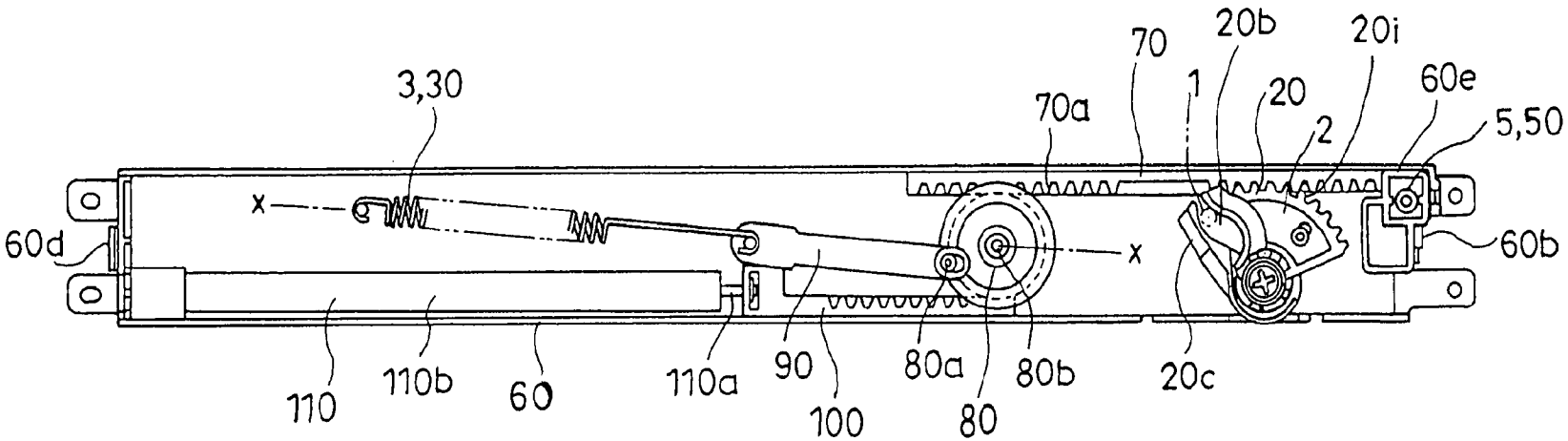
FIG. 4 is a bottom view of the essential parts of the same assist device.
Figure 5:
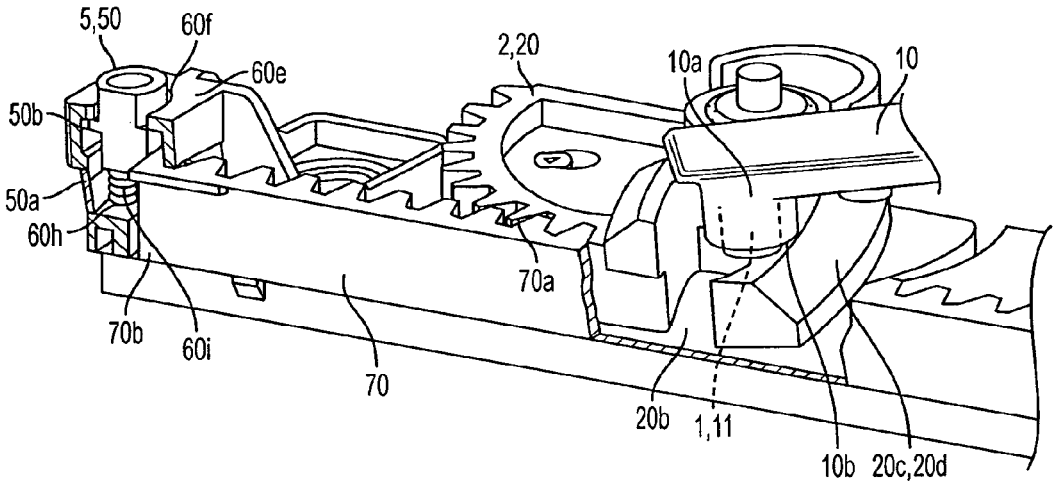
FIG. 5 is a perspective view of the same essential parts (the upper side of the figure is the lower side).
Figure 6A:
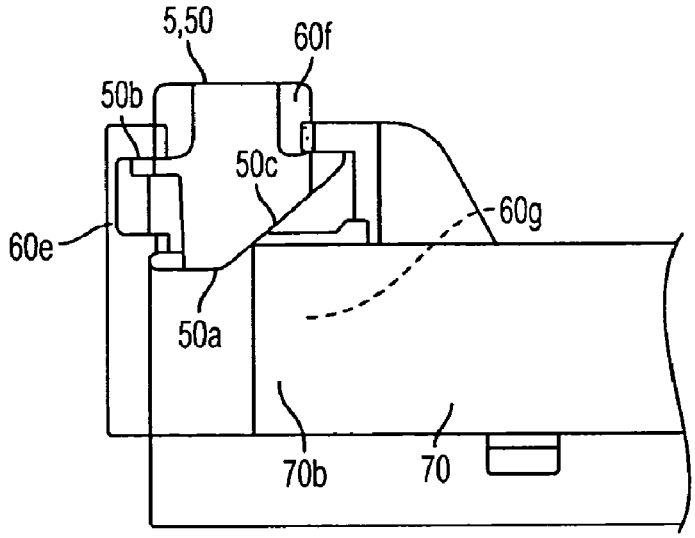
FIGS. 6(*a*), 6(*b*) are broken views of the same essential parts (In FIG. 6(*a*), the upper side of the figure is the lower side), and a bottom face structural view of the same essential parts (FIG. 6(*b*)).
Figure 6B:
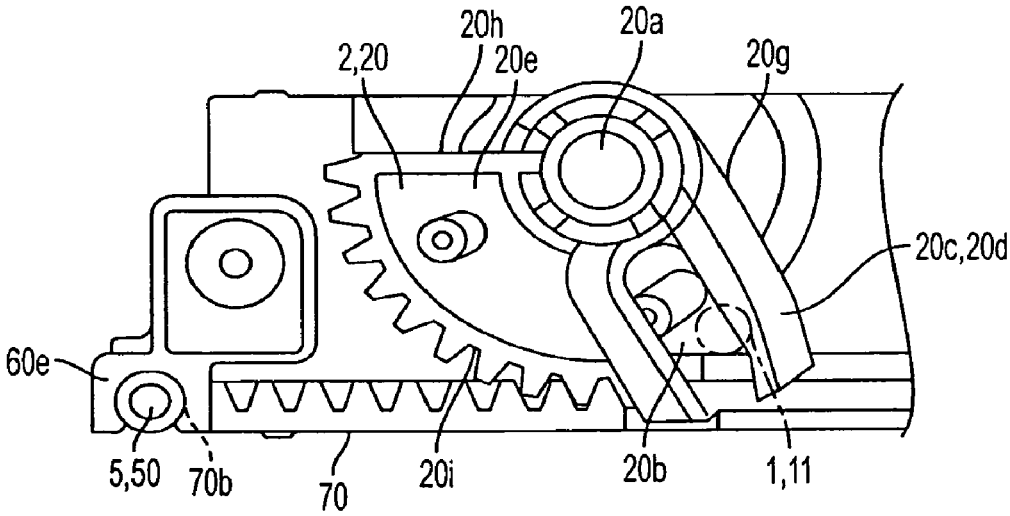
Figure 7A:
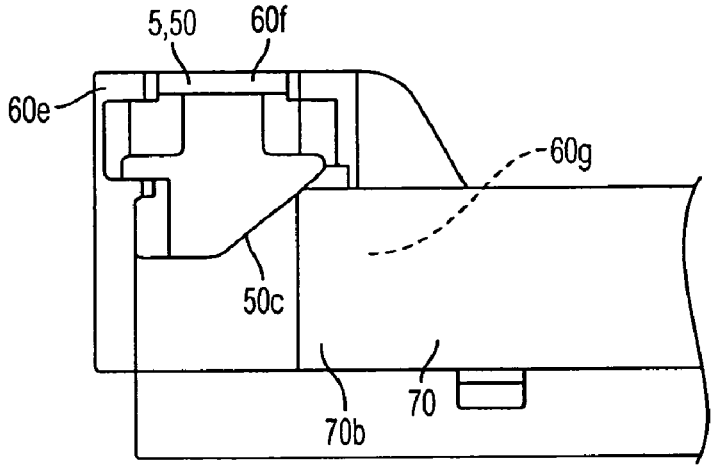
FIGS. 7(*a*), 7(*b*) are broken views of the same essential parts (In FIG. 7(*a*), the upper side of the figure is the lower side), and a bottom face structural view of the same essential parts (FIG. 7(*b*)).
Figure 7B:
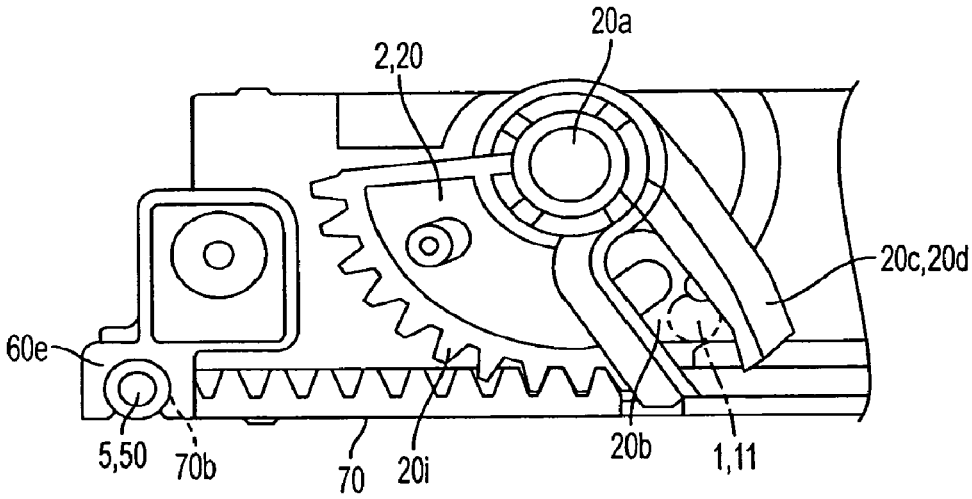
Figure 8:
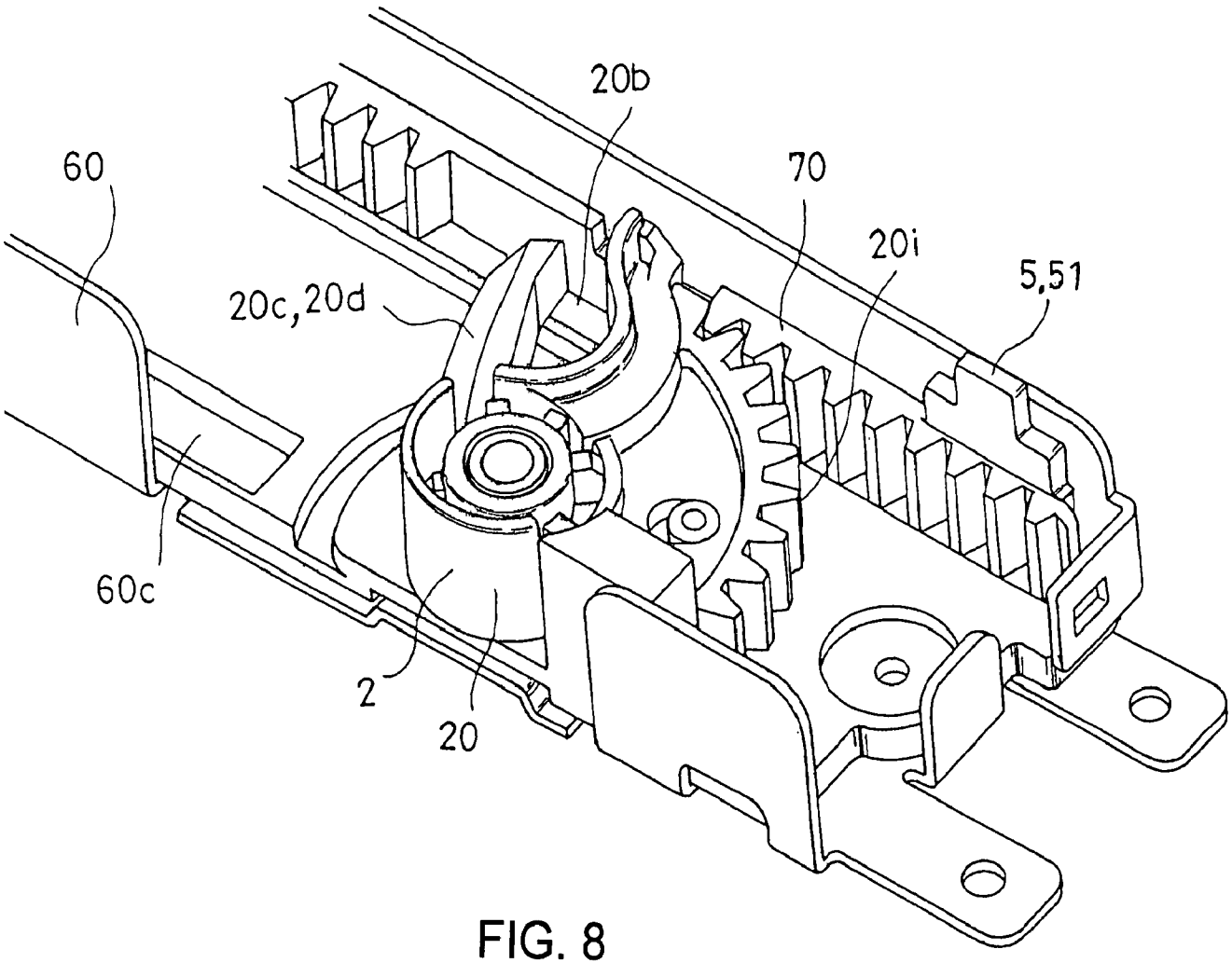
FIG. 8 is a perspective view of the essential parts of the assist device showing another structural example of operation means.
Figure 9:
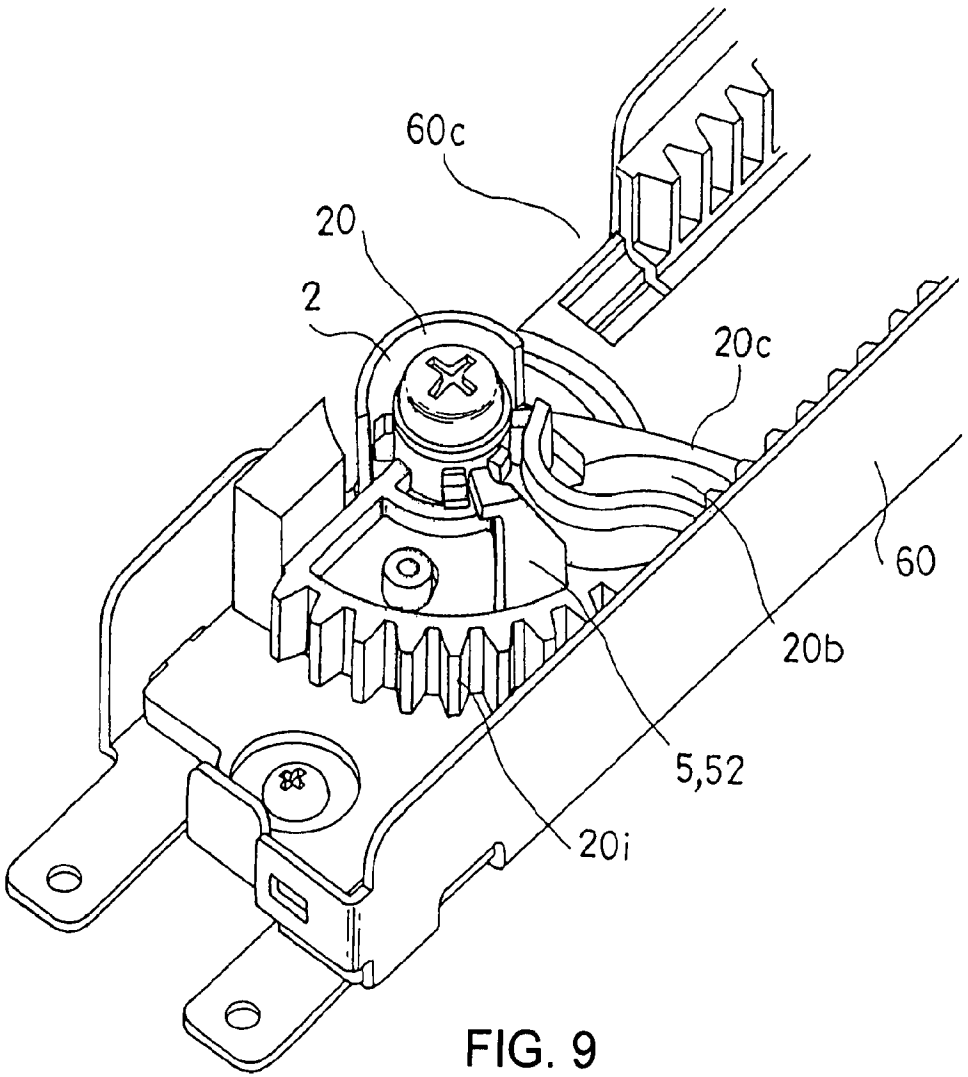
FIG. 9 is a perspective view of the essential parts of the assist device showing yet another example of the operation means.

Incidentally, here, FIG. 1 to FIG. 9 show an example using an assist device so as to assist a forward movement of a door Ma, from another viewpoint, so as to completely close the door Ma, and also from another viewpoint, so as to slowly close the door Ma at the end of the forward movement. FIG. 1 shows an example of an installed condition thereof viewed from the lower side, FIG. 2 shows essential parts such as a door Ma and the like in section, FIG. 3 shows the essential parts of the assist device wherein a catcher member 2 is positioned in a standby position viewed from the lower side, and FIG. 4 shows the essential parts of the assist device wherein the catcher member 2 is positioned in a retracted position viewed from the lower side, respectively. FIG. 5 shows a state wherein a striker axis 11 of a striker member 1 cannot enter into an engaging recess 20*b* of the catcher member 2 which is in the retracted position even if the door Ma is moved up to a position where the movement ends in the case wherein the catcher member 2 is moved to the retracted position without catching the striker member 1. FIGS. 6(*a*) and 6(*b*) show the essential Parts such as operation means 5 and the like viewed from the lateral side (FIG. 6(*a*)) and also viewed from the lower side (FIG. 6(*b*)) in the above-mentioned state. Also, FIGS. 7(*a*), 7(*b*) show the essential parts such as the operation means 5 and the like viewed from the lateral side (FIG. 7(*a*)) and also viewed from the lower side (FIG. 7(*b*)) when the striker axis 11 of the striker member 1 enters into the engaging recess 20*b* of the catcher member 2 by operating the operation means 5 from states of FIGS. 6(*a*) and 6(*b*). Also, FIG. 8 shows another example of the operation means 5, and FIG. 9 shows yet another example, respectively.

Figure 10:
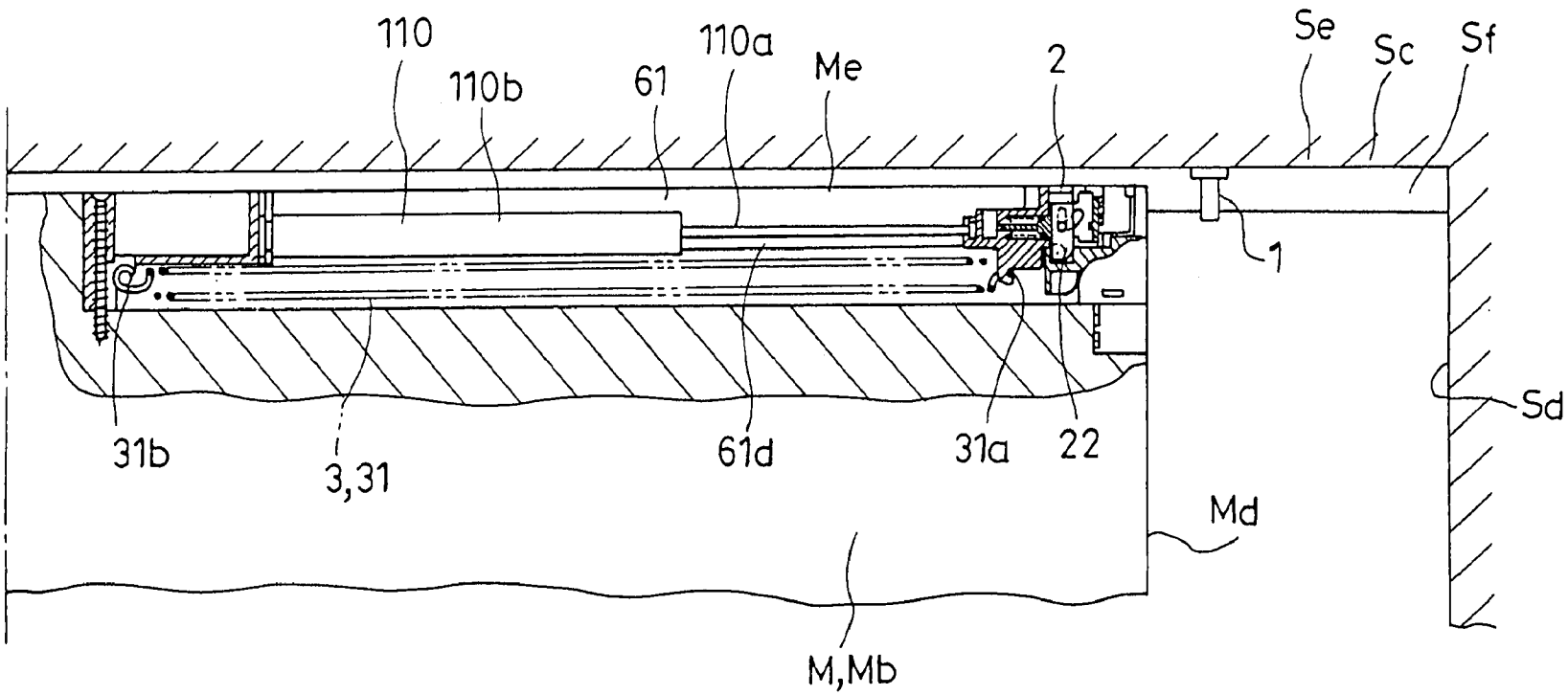
FIG. 10 is a partial sectional view of the essential parts taken along line 10-10 in FIG. 12, showing the use state in the case wherein the assist device is used with a sliding door.
Figure 11:
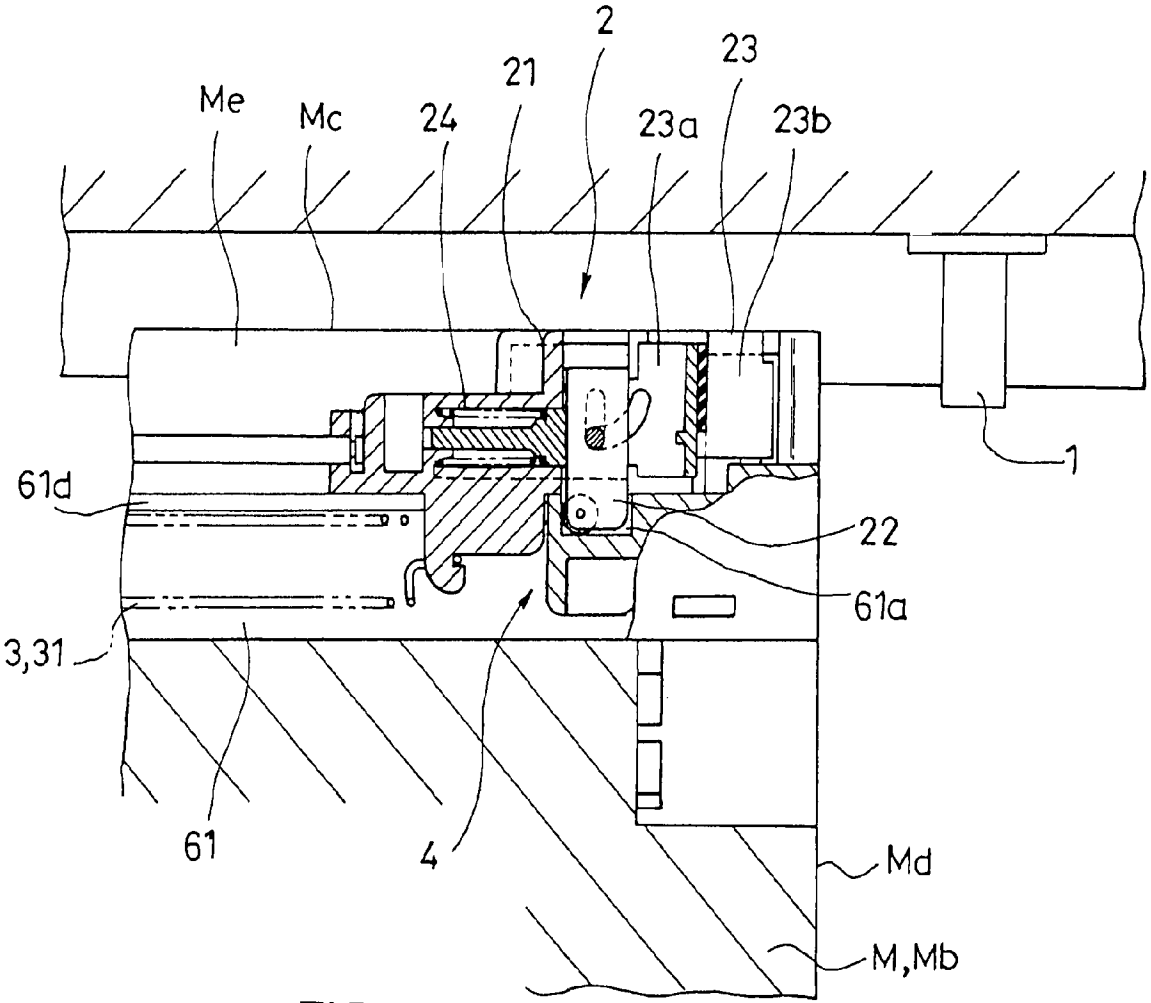
FIG. 11 is an enlarged view of the essential parts of FIG. 10.
Figure 12:
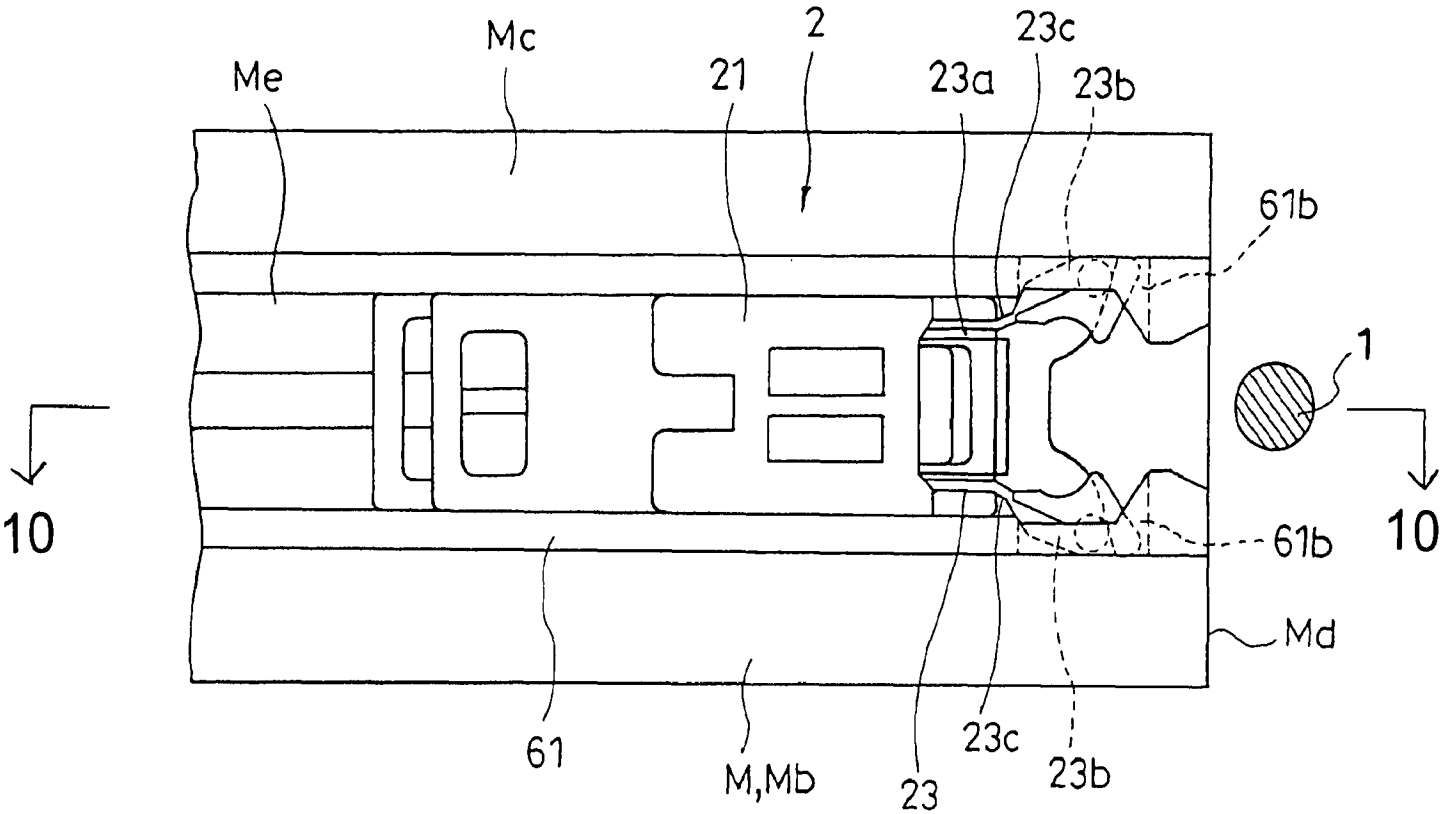
FIG. 12 is a plan structural view of portions shown in FIG. 11.
Figure 13:
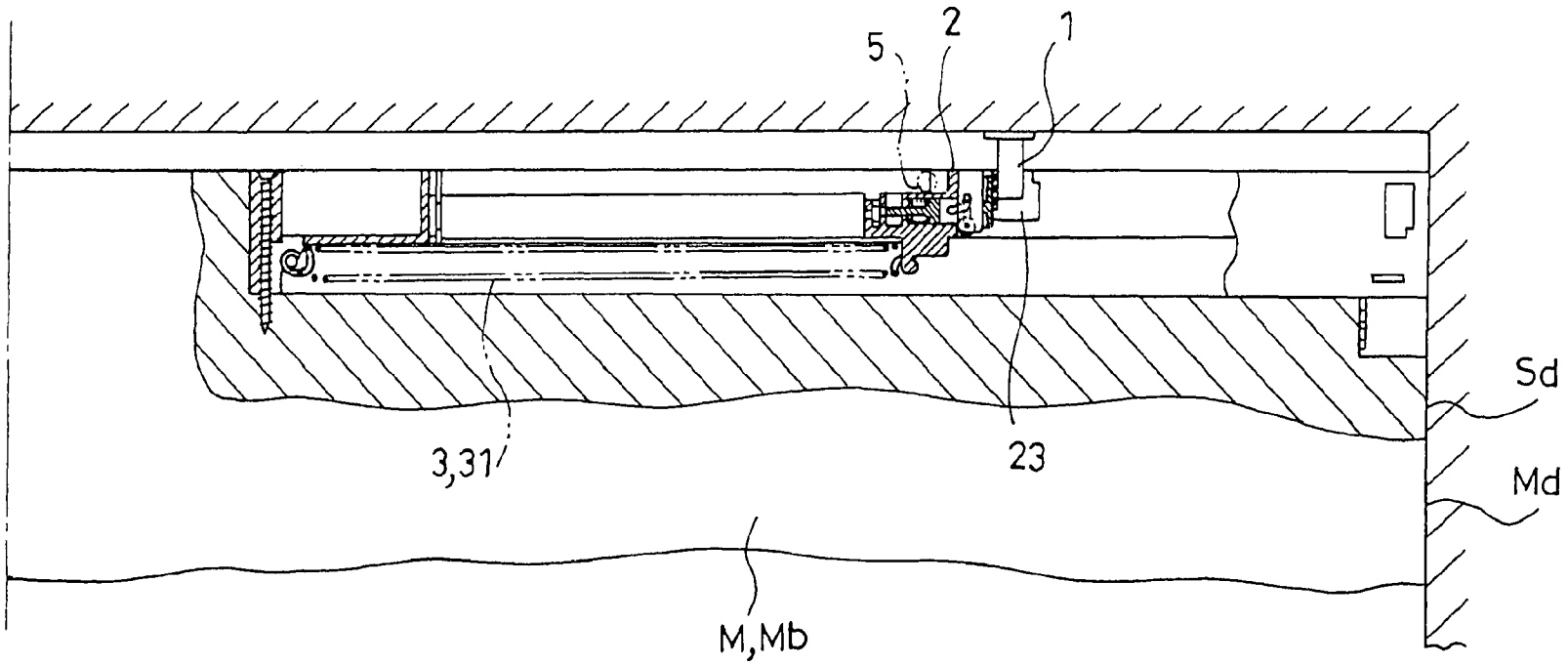
FIG. 13 is a partial sectional view of the essential parts taken along line 13-13 in FIG. 15, showing the use state in the case wherein the assist device is used with the sliding door.
Figure 14:
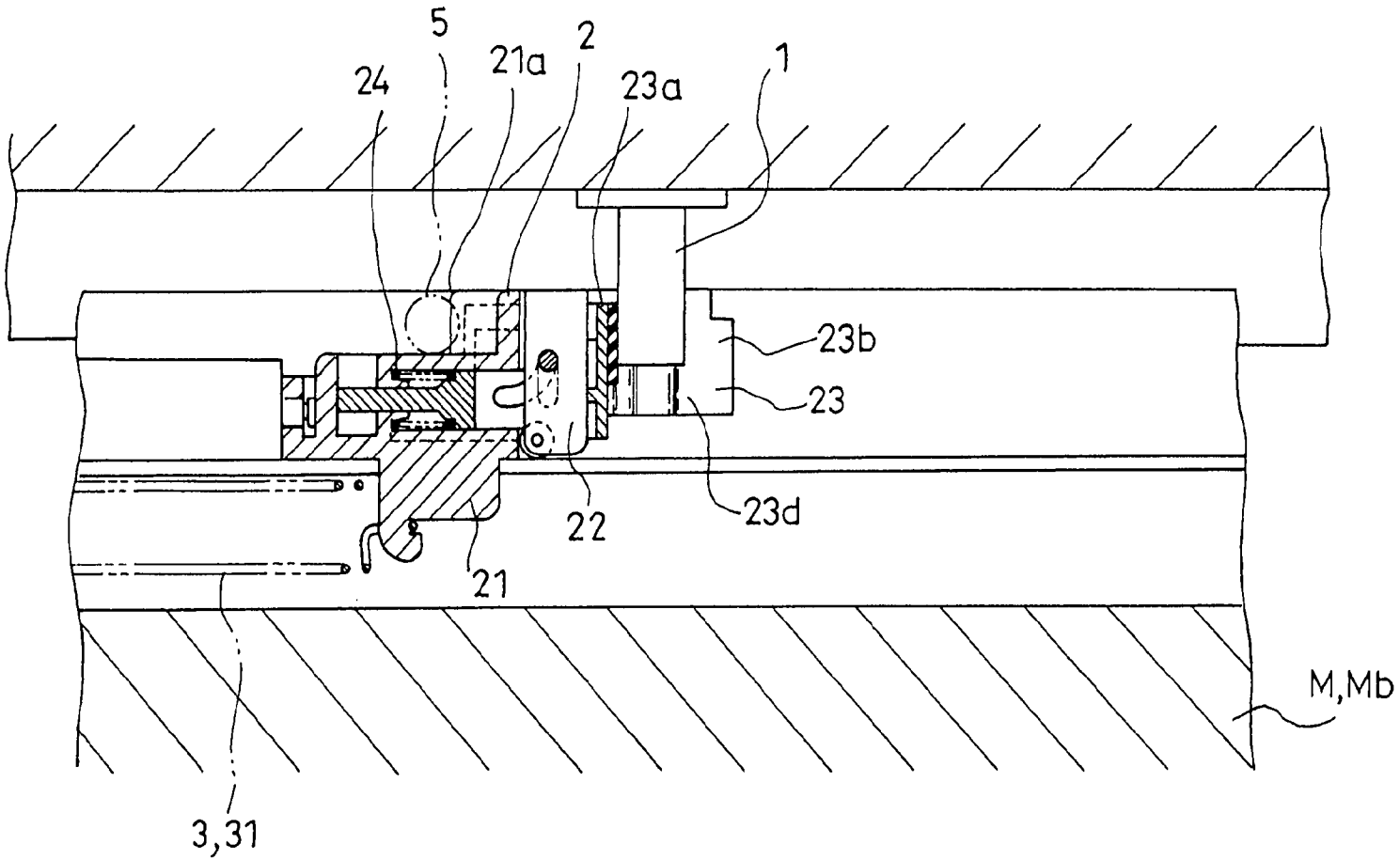
FIG. 14 is an enlarged view of the essential parts of FIG. 13.
Figure 15:
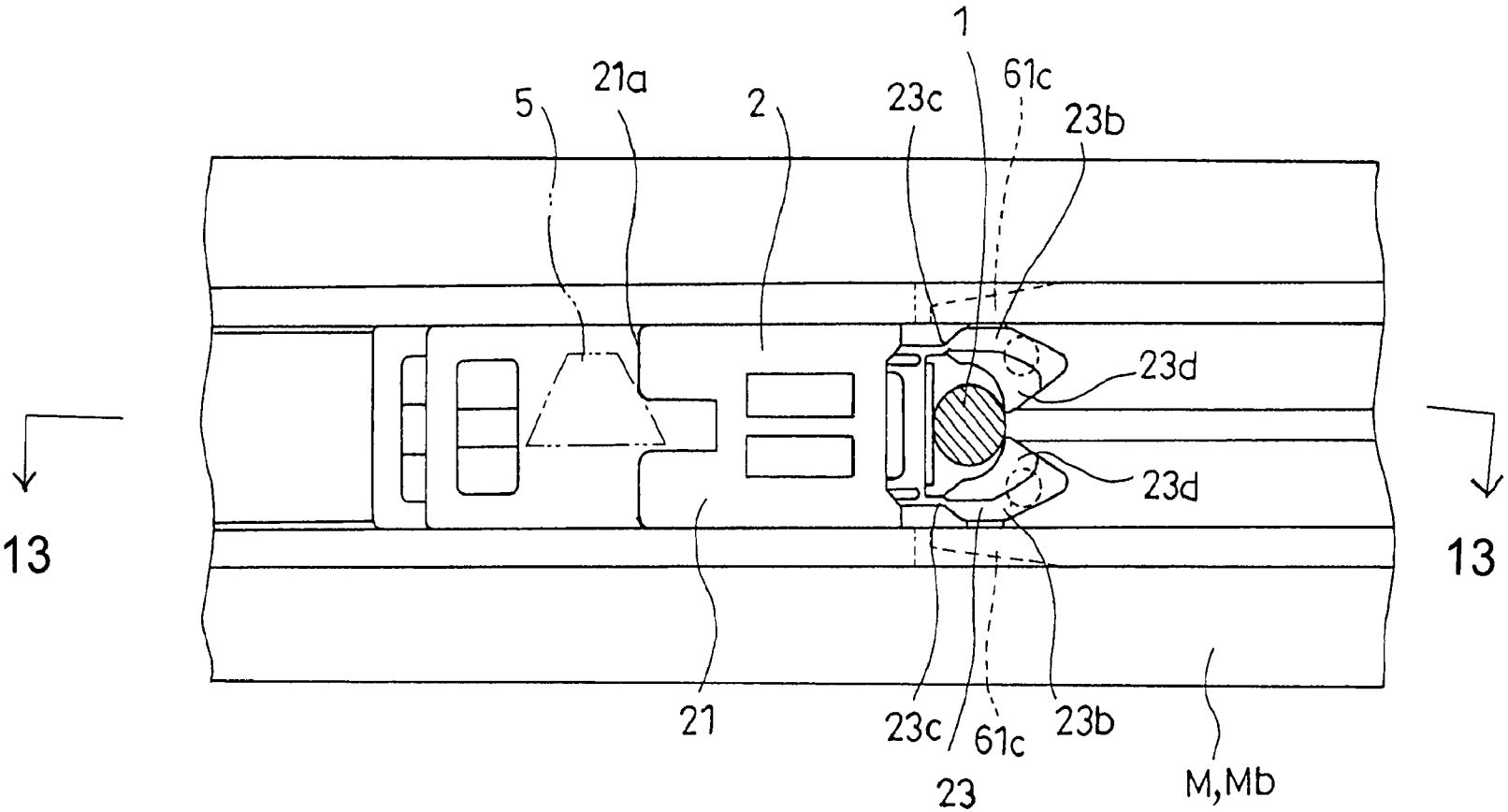
FIG. 15 is a plan view of portions shown in FIG. 14.
Figure 16:
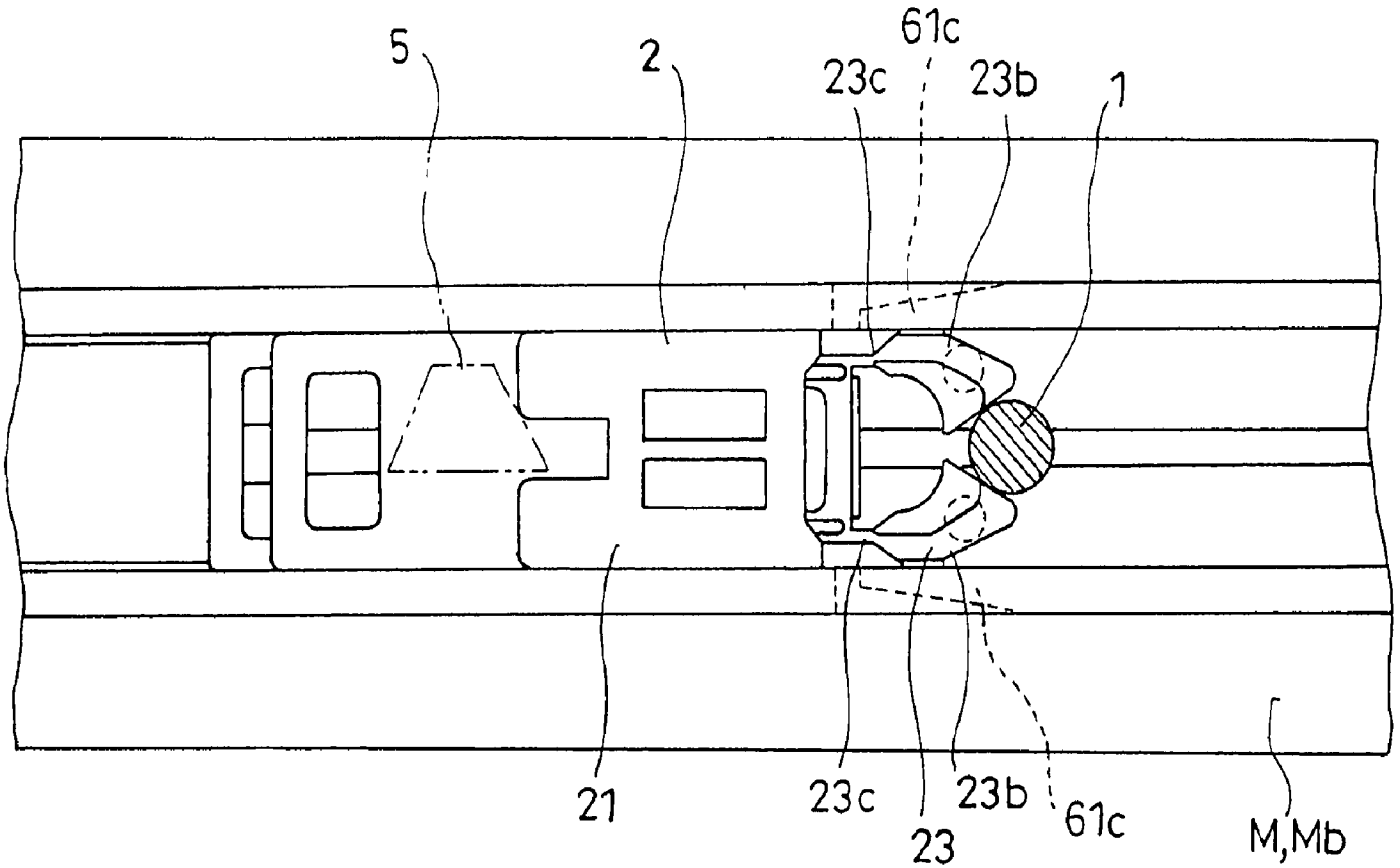
FIG. 16 is a plan view of the portions shown in FIG. 14 (a state wherein a striker member 1 cannot be caught and engaged).
Figure 17:
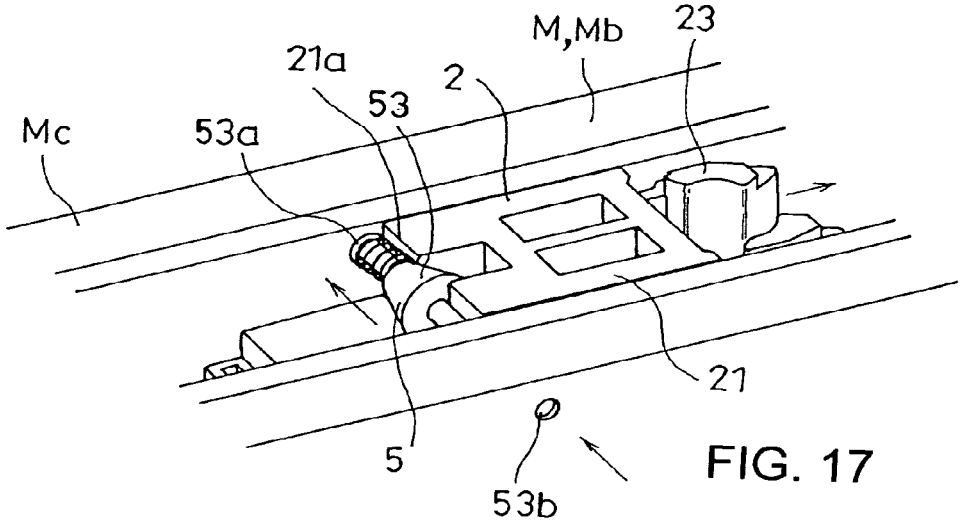
FIG. 17 is an example of the operation means (the first example).
Figure 18:
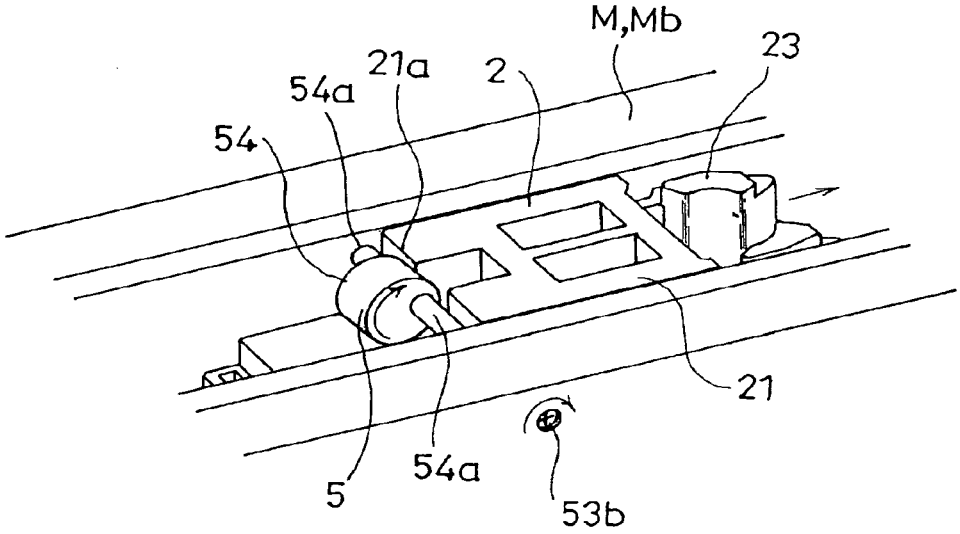
FIG. 18 is an example of the operation means (the second example).
Figure 19:
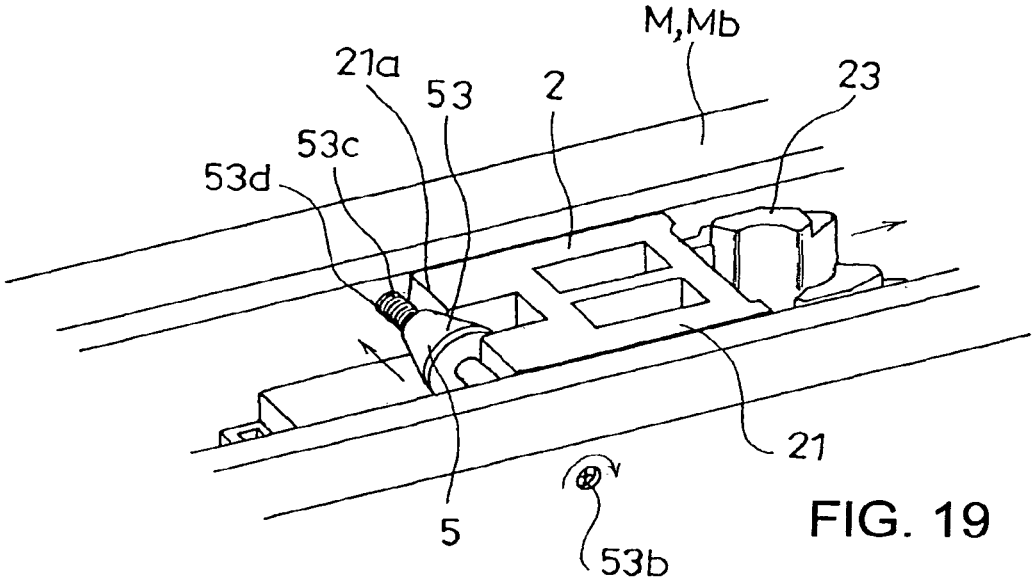
FIG. 19 is an example of the operation means (the third example).
Figure 20:
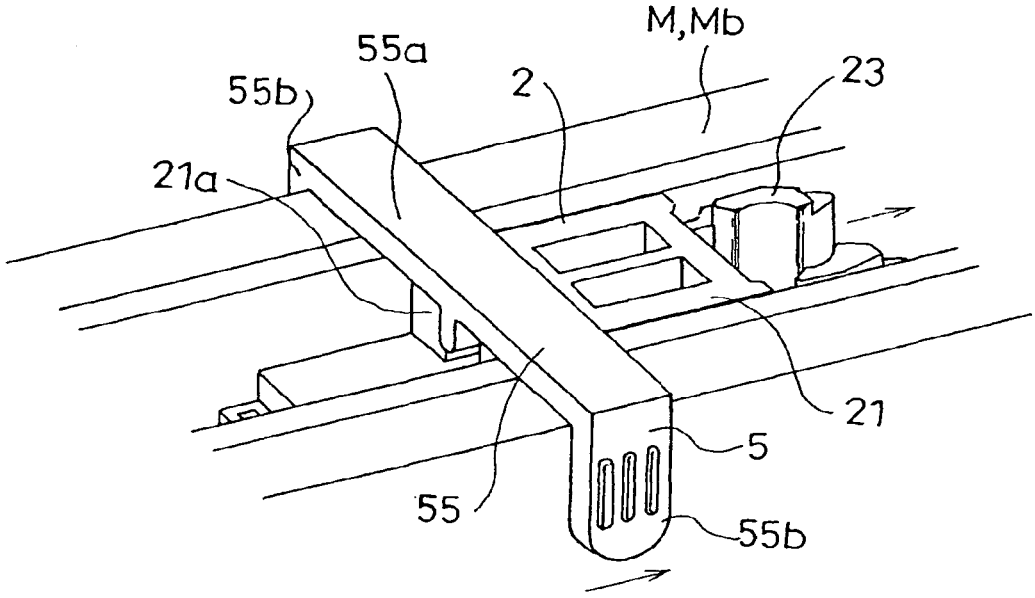
FIG. 20 is an example of the operation means (the fourth example).

Also, FIGS. 10 to 20 show examples using the assist device so as to assist the forward movement of a sliding door Mb, from another viewpoint, so as to completely close the sliding door Mb, and also from another viewpoint, so as to slowly close the sliding door Mb at the end of the forward movement. FIG. 10 shows a state just before the sliding door Mb is moved forward to a predetermined movement position where the catcher member 2 of the assist device is in the standby position as a state of the upper part of the sliding door Mb in section. FIG. 11 shows the enlarged essential parts of FIG. 10, and FIG. 12 shows the essential parts of FIG. 11 viewed from the upper side, respectively. Also, FIG. 13 shows a state wherein the catcher member 2 of the assist device is in the retracted position and the sliding door Mb is in the position where the movement ends as a state wherein the upper part of the sliding door Mb is in section. FIG. 14 shows the enlarged essential parts of FIG. 13, and FIG. 15 shows the essential parts of FIG. 14 viewed from the upper part, respectively. FIG. 16 shows a state wherein the striker member 1 cannot be caught and engaged with the catcher member 2 which is in the retracted position even if the sliding door Mb is moved up to the position where the movement ends in the case wherein the catcher member 2 is moved to the retracted position without catching the striker member 1. FIG. 17 shows the first example of a structural example of the operation means for solving the state of FIG. 16, FIG. 18 shows the second example thereof, FIG. 19 shows the third example thereof, and FIG. 20 shows the fourth example thereof, respectively.

The assist device of a movable body according to the present embodiment assists at least the forward movement of a movable body M which is supported by a stationary body S up to the position where the movement ends from a predetermined movement position due to urging means 3.

Such an assist device typically can be used for the door Ma, a swing door or the like which pivots, the sliding door Mb, an overhung door or the like which slides, or the like, as the movable body M.

Such assist device includes the striker member 1 which is provided in either one of the stationary body S or the movable body M, and the catcher member 2 which is provided in the other one of those.

The catcher member 2 is provided so as to be movable between the standby position and the retracted position, and also at the standby position, the catcher member 2 is positioned in the standby position by holding means 4 while being urged by urging means 3. Then, when the movable body M is moved forward to the predetermined movement position, the striker member 1 is caught and engaged with the catcher member 2 which is positioned in the standby position, and subsequently, holding by the holding means 4 is released to allow the catcher member 2 to move or relatively move up to the retracted position by being urged by the urging means 3, so that the urging force is applied to the movable body M up to the position where the movement ends.

Thereby, according to such assist device, the movable body M which was moved forward up to the predetermined movement position can be moved up to the position where the movement ends by the catcher member 2 which is moved or relatively moved to the retracted position by the urging while catching the striker member 1 at the predetermined movement position. If the movable body M which was moved to the position where the movement ends in such manner is moved backward, the catcher member 2 which is in the retracted position with catching the striker member 1 is moved or relatively moved up to the standby position while being urged by the urging means 3, and at the standby position, the catcher member 2 is repositioned by the holding means 4. Also, the catcher member 2 releases the striker member 1 from being caught and engaged. (Release)

At the same time, such assist device according to the embodiment comprises the operation means 5 allowing the catcher member 2 which was moved to the retracted position without catching the striker member 1, to move toward the standby position.

If the holding of the catcher member 2 by the holding means 4, is inadvertently released from the state wherein the movable body M is not moved forward to the predetermined movement position, the catcher member 2 happens to move to the retracted position without catching the striker member 1 by the urging. In such case, a return to a desired state is attempted to be carried out by allowing the movable body M to move up to the position where the movement ends, and the striker member 1 to be caught and engaged with the catcher member 2 which is in the retracted position. Therefore, in a case wherein an assembled or combined state of the movable body M relative to the stationary body S was damaged for some reason, for example, in a case such that the door frame Ma as the stationary body S or the door Ma as the movable body M had a deviation or the like, even if the movable body M is moved up to the position where the movement ends, the striker member 1 cannot enter into an engaging portion of the catcher member 2 which is in the retracted position. In the assist device according to the embodiment, even in such case, the striker member 1 can be caught and engaged with the catcher member 2 by moving the catcher member 2 toward the standby position by a dimension of the deviation as mentioned above by the operation means 5.

(Examples Shown in FIG. 1 to FIG. 9)

In FIG. 1 to FIG. 9, such assist device assists the forward movement (pivoting in a closing direction) of the door Ma up to the position where the movement ends (the position where the door Ma is completely closed) from the predetermined movement position (the position just before the door Ma is closed). In the illustrated examples, the movable body M is the door Ma, and the stationary body. S is the door frame Sa. Also, in the illustrated examples, the catcher member 2 is attached to the lower surface of an upper frame portion Sb of the door frame Sa, and corresponding to this, the striker member 1 is attached to the upper part of the door Ma.

In this example, the striker member 1 is constituted by a striker base 10 and a striker axis 11 projecting is biased so as to be retractable from the striker base 10. One end of the striker base 10 is fixed to the door Ma, and also the other end of the striker base 10 includes a housing tube portion 10*a* of the striker axis 11 projecting toward the upper side. (FIG. 5) The striker axis 11 is structured so as to project the upper end thereof toward the upper side from an open tube upper end 10*b* of the housing tube portion 10*a* by the urging.

On the other hand, the catcher member 2 is structured as a pivotal body 20 provided with a pivot axis 20*a* in a direction along an axial line of the striker axis 11, and also comprises the engaging recess 20*b* of the striker axis 11 which is open in the outer circumference thereof and continues toward the pivot center side thereof. When the door Ma as the movable body M is moved forward to the predetermined movement position, the striker axis 11 enters into the engaging recess 20*b* of the catcher member 2 which is in the standby position (position in FIG. 3), and due to the subsequent urging of the urging means 3, the catcher member 2 is pivoted to the retracted position (position in FIG. 4), so that the urging force is applied to the door Ma up to the position where the movement ends. If the door Ma is moved backward from the position where the movement ends, the catcher member 2 is pivoted again up to the standby position, and due to the holding means 4, the catcher member 2 is repositioned, and also releases the striker axis 11.

In this example, in the state wherein the catcher member 2 is moved to the retracted position without catching the striker member 1, due to the retraction of the striker axis 11 against the urging accompanied with the abutting against a lateral portion 20*c* of the engaging recess 20*b* in the striker member 1, the forward movement of the movable body M toward the position, where the movement ends, is possible. An inclined surface 20*d* which allows such retraction is formed on the lower surface side of such lateral portion 20*c*.

In this example, in the case wherein the catcher member 2 is moved into the retracted position without catching the striker member 1, if the movable body M is moved forward up to the position where the movement ends, the striker axis 11 hits the lateral portion 20*c* of the engaging recess 20*b* in the striker member 1, and retracts against the urging once, so that the lateral portion 20*c* of a projecting end of the striker axis 11 can cross over. Then, after this crossing over, due to the urging, the striker axis 11 projects again by the urging, and is entered into the engaging recess 20*b* of the catcher member 2 which is in the retracted position, so that the striker axis 11 is caught and engaged. In the case wherein the assembled or combined state of the door Ma as the movable body M relative to the door frame Sa as the stationary body S had the deviation and the like, even if the door Ma is moved up to the position where the movement ends, the striker axis 11 of the striker member 1 cannot be entered into the engaging recess 20*b* of the catcher member 2 which is in the retracted position. (FIGS. 5, 6(*b*)) In the assist device according to, this example, even in such case, due to the operation means 5, the catcher member 2 can be pivoted toward the standby position for the dimension of the deviation and the like, up to the position where the striker axis 11 of the striker member 1 is entered into the engaging recess 20*b* of the catcher member 2. (FIGS. 7(*a*) and 7(*b*))

In the illustrated examples, the catcher member 2 is assembled and housed so as to be pivotal in a casing 60 whose upper surface is an attachment surface 60*a* which is attached to the lower surface of the upper frame portion Sb of the door frame Sa. The casing 60 is constituted so as to form a slender box shape whose lower surface is open. The catcher member 2 is provided in a position slanting to an end 60*b* side of the casing 60. On the lateral side of the disposed portion of the catcher member 2 in the casing 60, an open portion 60*c*, wherein the formation portion of the engaging recess 20*b* of the catcher member 2 which is in the standby position projects, is formed.

The catcher member 2 is structured by forming the engaging recess 20*b* to have a split groove shape whose one end is open in the arcuate border 20*f* thereof, and which continues to the pivot axis 20*a* (i.e., the pivot center side), in a fan-shaped body 20*e* wherein the formation side of the pivot axis 20*a* is an essential part. The engaging recess 20*b* in the catcher member 2 is provided in the position which is the other side of the fan-shaped body 20*e* and slants to a linear border 20*g*. A gear portion 20*i* which engages a rack 70*a* provided along a sliding direction of a slider 70 which is supported by and combined with the casing 60 so as to be slidable in a length direction of the casing 60, is formed in the arcuate border 20*f* extending between the engaging recess 20*b* of the catcher member 2 and the other linear border 20*h* of the fan-shaped body 20*e*.

A pinion 80 engaging the rack 70*a* of such slider 70 is provided between the other end 60*d* in the casing 60 and the catcher member 2. Also, in the casing 60, an extension coil spring 30 whose one end 30*b* is attached to the other end 60*d* side of the casing 60 and also wherein a linkage part 90 is clamped in the other end 30*a* and connected to the pinion 80, is provided as the urging means 3. The linkage part 90 is pivotally supported by the pinion 80 in the position slanting to a rotational axis of the pinion 80. Then, in the illustrated examples, when the pivot supporting portion 80*a* is positioned on an imaginary straight line x passing a rotational center 80*b* of the pinion 80 and an attached portion of the spring one end 30*b* of the extension coil spring 30, the spring 30 is maximally stretched. Also, when the pivot supporting portion 80*a* is positioned at the back further than this imaginary straight line x, the slider 70 is moved the most to the other end 60*d* side of the casing 60, and in this state, the catcher member 2 is positioned in the standby position by the spring 30. (FIG. 3) On the other hand, when the pivot supporting portion 80*a* is positioned in front further than the imaginary straight line x, the slider 70 is moved maximally to one end 60*b* side of the casing 60, and in this state, the catcher member 2 is positioned in the retracted position by the spring 30. (FIG. 4) Specifically, in this example, the holding means 4 is constituted by such spring 30 and the pinion 80.

A supporting portion 60*e* supporting a button body 50 so as to be movable up and down, is formed on the one end 60*b* side of the casing 60. The supporting portion 60*e* comprises a projecting opening 60*f* of the button body 50 on the lower side, and an entering opening 60*g* of the end portion of the slider 70 on the lateral side, respectively. The button body 50 projects the outer end thereof from the supporting portion 60*e* with hooking a jaw portion 50*b* on the inner edge of the projecting opening 60*f* of the supporting portion 60*e* by a spring 60*i* which is installed between a back portion 60*h* of the supporting portion 60*e* and an inner end 50*a* of the button body 50. On the side facing the entering opening 60*g* in the button body 50, an abutment surface 50*c* to an end portion 70*b* of the slider 70 forming a tilt in a direction gradually separating from the movement center axis of the button body 50 as going to the lower side, is formed. Then, in the illustrated examples, when the catcher member 2 is in the standby position, the end portion 70*b* of the slider 70 is entered into the supporting portion 60*e*, and positioned in the upper side of the hitting surface 50*c* of the button body 50. (FIG. 6(*a*))

In the case that the catcher member 2 is moved to the retracted position without catching the striker member 1 because there is the deviation and the like in the assembled or combined state of the door Ma relative to the door frame Sa, even if the door Ma is moved up to the position where the movement ends, when the striker axis 11 of the striker member 1 cannot enter into the engaging recess 20*b* of the catcher member 2 which is in the retracted position, (FIGS. 5, 6(*b*)) if the button body 50 is pushed into the upper side, the slider 70 can be slightly moved to the other end 60*d* side of the casing 60. With this, the catcher member 2 can be slightly pivoted toward the standby position until the striker axis 11 of the striker member 1 is entered into the engaging recess 20*b*. (FIGS. 7(*a*), 7(*b*)) Specifically, in this example, such button body 50 functions as the operation means 5. Then, the button body 50 as the operation means 5 allows the catcher member 2 to move toward the standby position via the slider 70 as a transmission member which transmits the urging force of the spring 30 as the urging means 3 to the catcher member 2.

FIG. 8 shows the example wherein a knob portion 51 projecting to the lower side is formed in the slider 70 itself as the transmission member, and due to the movement of the rack 70*a* using the knob portion 51, the catcher member 2 which is in the retracted position is pivoted toward the standby position. Specifically, in this example, such knob portion 51 functions as the operation means 5.

Also, FIG. 9 shows the example wherein a knob portion 52 projecting to the lower side is formed in the catcher member itself and in the position decentered from the rotational center thereof, and due to the pivoting of the catcher member 2 using the knob portion 52, the catcher member 2 which is in the retracted position is pivoted toward the standby position. Specifically, in this example, such knob portion 52 functions as the operation means 5.

Incidentally, in the illustrated examples, a damper slider 100 engaging the rack with the pinion 80 at a side (front) opposite to a side engaging with the slider 70 is supported to be slidable in the direction along the length direction of the casing 60. Also, a piston damper 110 which allows a piston rod 110*a* to move into a cylinder 110*b* due to the movement toward the other end 60*d* side of the casing 60 of the damper slider 100, is built into the casing 60. Due to the piston damper 110, breaking is applied to the rotation of the catcher member 2 toward the retracted position from the standby position, so that the movement of the door Ma toward the position where the movement ends can be slowly carried out. Also, an open lower surface 60*j* of the casing 60 is covered by a lid body which is not shown and includes a split groove along a movement trajectory of the striker axis 11.

(Examples Shown in FIGS. 10 to 20)

In FIGS. 10 to 20, such assist device assists the forward movement (sliding movement in a closing direction) of the sliding door Mb up to the position where the movement ends (position where the sliding door Mb is completely closed) from the predetermined movement position (position slightly before the sliding door Mb is closed). In the illustrated examples, the movable body M is the sliding door Mb, and the stationary body S is a door frame Sc of the sliding door Mb. Also, in the illustrated examples, the catcher member 2 is embedded in a groove-shaped space Me which is formed in the upper part of the sliding door Mb and provides a groove opening on an upper end surface Mc of the sliding door Mb, and whose one end of the groove is open outward in a front end Md of the sliding door Mb. Corresponding to this, the striker member 1 is attached so as to project to the down side from the back portion of a guiding groove Sf which is in the upper end of the sliding door Mb in the upper frame portion Se on a door stop Sd side of the door frame Sc.

In this example, the striker member 1 is constituted so as to form an axis shape whose upper end is attached to the above-mentioned position.

On the other hand, the catcher member 2 is housed inside the groove-shaped space Me so as to be movable along a movement direction of the sliding door Mb. The catcher member 2 includes a catcher stopper 22 provided so as to be retractable in an up-and-down direction relative to a catcher main body 21, a retaining body 23 of the striker member 1 which is provided so as to be movable backward and forward and also receives the striker member 1 from the front in a non-retaining state, and an urging body 24 for same. The catcher stopper 22 and the retaining body 23 are coordinated, and when the catcher stopper 22 projects from the catcher main body 21 by such urging body 24, the retaining body 23 is in a forward movement position and in the non-retaining state. (FIG. 12) Also, when the retaining body 23 is in a rearward position and in a retaining state, the catcher stopper 22 is retracted inside the catcher main body 21. (FIG. 15) Also, inside the groove-shaped space Me, an engaging hole 61*a* of the catcher stopper 22 when the catcher stopper 22 projects, is formed. In the standby position of the catcher member 2 wherein the catcher stopper 22 is engaged with the engaging hole 61*a*, the urging means 3 is urged. Then, the striker member 1 moves into the retaining body 23 of the catcher which is in the standby position when the movable body M is moved forward up to a self-propelled start position.

If the striker member 1 is entered into the retaining body 23 of the catcher member 2 which is in the standby position (position in FIG. 10) when the sliding door Mb as the movable body M is moved forward to the predetermined movement position, the retaining body 23 is pushed by this and moved to the backward movement position, and the striker member 1 is retained, caught, and engaged. If the retaining body 23 is moved to the rearward position, the catcher stopper 22 is pulled into the catcher main body 21, and the engagement with the engaging hole 61*a* is released, so that the catcher member 2 which is locked in the door frame Sc as the stationary body S via the striker member 1 is moved relatively to the retracted position (position in FIG. 13) by the urging of the urging means 3 so as to apply the urging force to the sliding door Mb up to the position where the movement ends. If the sliding door Mb is moved backward from the position where the movement ends, the catcher member 2 is relatively moved up to the standby position again, the catcher stopper 22 is reentered into the engaging hole 61*a* by the operation of the urging body 24, and also the retaining body becomes the non-retaining state and releases the striker member 1.

Specifically, in this example, the holding means 4 is constituted by such catcher stopper 22 and the engaging hole 61*a*.

In this example, in the case wherein the catcher member 2 is moved to the retracted position without catching the striker member 1, if the sliding door Mb as the movable body M is moved forward up to the position where the movement ends, the retaining body 23 of the catcher member 2 which is in the retracted position and in the backward movement position retains, catches, and engages the striker member 1.

Specifically, in this example, the retaining body 23 is constituted by integrally connecting a slide body 23*a* combined with the catcher main body 21 so as to be movable backward and forward, and a right and left pair of retaining pieces 23*b*, 23*b* by resin hinge portions 23*c* ranging between the front end of the slide body 23*a* and the back end of the retaining piece 23*b*. At the same time, notches 61*b* which allow the retaining pieces 23*b* of the retaining body 23 of the catcher member 2 which is in the standby position to enter in, are formed in a portion of the inner wall along the movement direction of the sliding door Mb in the casing 60 constituting the groove-shaped space Me. Also, (FIG. 12) an elastic deformation portion 61*c* which allows expansion to start to the outside as the center of the resin hinge portions 23*c* of the retaining pieces 23*b* of the retaining body 23 of the catcher member 2 which is in the retracted position, i.e., allows elastic movement to the non-retaining state, is formed. (FIG. 15) The retaining body 23 of the catcher member 2 which is in the standby position is in the forward movement position, and a space allowing the striker member 1 to enter therein, is formed between the inside projecting portions 23*d* of the pair of retaining pieces 23*b*, 23*b*. (Non-retaining state) If the movable body M is moved to the rearward position, the retaining pieces 23*b* slip out of the notches 61*b*, and by the inner wall of the casing 60, the pair of retaining pieces 23*b*, 23*b* elastically deforms the resin hinge portions 23*c* so as to assume the retaining state in which the striker member 1 cannot slip forwardly from between the inside projecting portions 23*d*. In the case wherein the catcher member 2 is moved to the retracted position without catching the striker member 1, the retaining body 23 of the catcher member 2 is in the retaining state. However, since the elastic deformation portion 61*c* is positioned outside the retaining pieces 23*b*, if the sliding door Mb is moved forward up to the position where the movement ends, the non-retaining state can be created by hitting the striker member 1 to the inside projecting portions 23*d* of the retaining pieces 23*b* from the front and opening the retaining pieces 23*b* to the outside once while deforming the elastic deformation portion 61*c*. Also, due to an elastic return of the elastic deformation portion 61*c* at the position where the striker member 1 crosses over the inside projecting portions 23*d*, the retaining body 23 is moved again to the retaining state, so that the striker member 1 can be retained and caught.

In the case that there is a deviation or the like in the assembled or combined state of the sliding door Mb as the movable body M relative to the door frame Sc as the stationary body S, even if the sliding door Mb is moved up to the position where the movement ends, the striker member 1 cannot enter between the right and left pair of retaining pieces 23*b*, 23*b* constituting the retaining body 23 of the catcher member 2 which is in the retracted position. (FIG. 16) In the assist device according to this example, even in such case, until the striker member 1 enters between the right and left pair of retaining pieces 23*b*, 23*b* constituting the retaining body 23 of the catcher member 2, the catcher member 2 can be pivoted toward the standby position for the dimension of the above-mentioned deviation or the like due to the operation means 5.

FIGS. 17, 19 show the example constituting such operation means 5 as a truncated conical body 53 supported by the casing 60 so as to contact the circumferential surface with a back end portion 21*a* of the catcher main body 21 of the catcher member 2 which is in the retracted position.

In the example in FIG. 17, such truncated conical body 53 is supported between the inner walls along the movement direction of the sliding door Mb of the casing 60 so as to be movable in a direction orthogonal to the movement direction. Also, the truncated conical body 53 is positioned while being urged by a spring 53*a* toward one of the inner wall sides. Such truncated conical body 53 can be pushed in against the urging of the spring 53*a* by a shaft-shaped tool via an operation hole 53*b* penetrating between the sliding door Mb and the casing 60. If the truncated conical body 53 is pushed in as above, the circumferential surface on the expanding radial side of the truncated conical body 53 contacts the back end portion 21*a* of the catcher main body 21, and this moves the catcher member 2 which is in the retracted position to a front end Md side of the sliding door Mb against the urging of the urging means 3.

In the example in FIG. 19, such truncated conical body 53 is supported between the inner walls along the movement direction of the sliding door Mb of the casing 60 so as to be movable in the direction orthogonal to the movement direction. Also, a male screw body 53*c* provided in the circle center is screwed into a female screw hole 53*d* formed in the casing 60. Such male screw body 53*c* can be operated by a tool and the like via the operation hole 53*b* penetrating between the sliding door Mb and the casing 60. Then, if the male screw body 53*c* is operated, the circumferential surface on the expanding radial side of the truncated conical body 53 can contact the back end portion 21*a* of the catcher main body 21, and thereby, the catcher member 2 which is in the retracted position is moved to the front end Md side of the sliding door Mb against the urging of the urging means 3.

Also, the example in FIG. 18 shows the example constituting such operation means 5 as a cylindrical body 54 supported by the casing 60 so as to contact the circumferential surface with the back end portion 21*a* of the catcher main body 21 of the catcher member 2 which is in the retracted position.

Such cylindrical body 54 is supported between the inner walls along the movement direction of the sliding door Mb of the casing 60 so as to be movable in the direction orthogonal to the movement direction. Also, the supporting axle 54*a* is provided in the position decentered from the circle center, and can be operated by the tool and the like via the operation hole 53*b* penetrating between the sliding door Mb and the casing 60. Then, by operating the supporting axle 54*a*, the circumferential surface of the cylindrical body 54 on a side far from the supporting axle 54*a* can contact the back end portion 21*a* of the catcher main body 21. Thereby, the catcher member 2 which is in the retracted position is moved to the front end Md side of the sliding door Mb against the urging of the urging means 3.

Also, the example in FIG. 20 shows the example constituting such operation means 5 as an operation piece 55 comprising a connecting portion 55*a* to the back end portion 21*a* of the catcher main body 21 of the catcher member 2, and operation portions 55*b* hanging to the lower side from a portion laterally projecting from the upper end surface Mc of the sliding door Mb in the connecting portion 55*a*. In such case, by using such operation piece 55, the catcher member 2 which is in the retracted position can be directly moved to the front end Md side of the sliding door Mb against the urging of the urging means 3.

In the illustrated examples, the catcher member 2 is combined and housed in the casing 60 which is embedded in the upper part of the sliding door Mb and whose inside is the groove-shaped space Me so as to be movable as mentioned above. The casing 60 is constituted so as to form a slender box shape whose upper surface is open. The casing 60 is divided into above and below by a dividing portion 61*d*, and the engaging hole 61*a* is formed in the dividing portion 61*d*. Also, on the lower side of the dividing portion 61*d*, an extension coil spring 31 as the urging means 3 is embedded. One end 31*a* of the spring 31 is attached to the catcher main body 21 of the catcher member 2, and the other end 31*b* of the spring 31 is attached to the end portion positioned on the back end side of the sliding door Mb in the casing 60. Then, in the state wherein the catcher member 2 is in the standby position, this spring 31 is stretched maximally. If the sliding door Mb is moved forward up to the predetermined movement position, the catcher member 2 catches the striker member 1 and halts. At the same time, the holding of the holding means 4 is released, so that due to the urging of the spring 31, the sliding door Mb moves up to the position where the movement ends, and the catcher member 2 is relatively moved to the retracted position inside the groove-shaped space Me. When the sliding door Mb which is in the position where the movement ends is moved backward up to the predetermined movement position, the catcher member 2 is relatively moved up to the standby position while being urged by the spring 31, and releases the striker member 1. At the same time, due to the holding means 4, the catcher member 2 is positioned in the standby position.

Incidentally, in the illustrated examples, in the back end portion 21*a* of the catcher main body 21 of the catcher member 2, the piston damper 110 which allows the piston rod 110*a* to move into the cylinder 110*b* due to the relative movement toward the retracted position of the catcher member 2 is combined inside the casing 60. Due to this piston damper 110, the braking is provided for the relative movement of the catcher member 2 toward the retracted position from the standby position, so that the movement of the sliding door Mb toward the position where the movement ends, is slowly carried out.

Incidentally, the entire contents of the Specification, Claims, Drawings and Abstract of Japanese Patent Application 2007-258647 filed on Oct. 2, 2007 are cited here and are incorporated as a disclosure of the specification of the present invention.

What is claimed is:

1. An assist device for a movable body assisting at least a forward movement of the movable body supported by a stationary body up to a position where movement ends from a predetermined movement position, comprising:

a striker member provided in one of the stationary body or the movable body, a catcher member provided in the other of the stationary body or the movably body, and provided so as to be movable between a standby position and a retracted position, urging means attached to the catcher member, holding means associated with the catcher member, the holding means holding the catcher member positioned in the standby position while being urged by the urging means, and operation means'associated with the catcher member and moving the catcher member in the retracted position, wherein when the movable body is moved forward to a predetermined movement position, the striker member is caught and engaged with the catcher member positioned in the standby position, and subsequently, holding of the holding means is released to allow the catcher member to move up to the retracted position by being urged by the urging means while an urging force of the urging means is being applied to the movable body up to the position where the movement ends, and wherein the operation means is arranged to move the catcher member, having been moved or relatively moved to the retracted position in a condition without catching the striker member, toward the standby position.

2. An assist device for a movable body according to claim 1, wherein the operation means moves the catcher member toward the standby position via a transmission member which transmits the urging force of the urging means to the catcher member.

3. An assist device for a movable body according to claim 1, wherein the operation means is integrally provided in the transmission member which transmits the urging force of the urging means to the catcher member.

4. An assist device for a movable body according to claim 1, wherein the operation means is integrally provided in the catcher member.

5. An assist device for a movable body according to claim 1, wherein the catcher member comprises a pivotal body rotationally fixed to a casing and having an engaging recess for receiving the striker and gear teeth on an outer periphery thereof, and a slider having gear teeth engaging the gear teeth of the pivotal body, said operation means being arranged to move the slider to rotate the pivotal body from the retracted position to the standby position.

6. An assist device for a movable body according to claim 1, further comprising a casing slidably retaining the catcher member therein and having an elastic deformation portion to be able to bend outwardly, said elastic deformation portion being formed in the casing adjacent the retracted position.

7. An assist device for a movable body according to claim 6, wherein said catcher member comprises a slide body holding the striker and having a hinge portion, said operation means being arranged to move the slide body at the retracted position in a direction toward the standby position to a position adjacent the elastic deformation portion to allow the slider body to bend outwardly at the elastic deformation portion.

8. An assist device for a movable body assisting at least a forward movement of the movable body supported by a stationary body up to a position where movement ends from a predetermined movement position by urging means, comprising:

a striker member provided in one of the stationary body or the movable body, and a catcher member provided in the other of the stationary body or the movable body, wherein the catcher member is provided so as to be movable between a standby position and a retracted position, and also at the standby position, the catcher member is positioned in the standby position by holding means while being urged by the urging means, and when the movable body is moved forward to a predetermined movement position, the striker member is caught and engaged with the catcher member positioned in the standby position, subsequently, holding of the holding means is released to allow the catcher member to move up to the retracted position by being urged by the urging means, and an urging force of the urging means is applied to the movable body up to the position where the movement ends, and furthermore, the assist device for the movable body comprises operation means that can operate to move the catcher member, having been moved or relatively moved to the retracted position in a condition without catching the striker member, toward the standby position, wherein the striker member comprises a striker base and a striker axis projecting so as to be retractable by being urged from the striker base, wherein the catcher member is a pivotal body, and also comprises an engaging recess for the striker axis which is open in an outer circumference thereof and continues toward a pivot center side thereof, and when the movable body is moved forward to the predetermined movement position, the striker axis enters into an engaging recess of the catcher member which is in the standby position, and due to subsequent urging of the urging means, the catcher member is pivoted to the retracted position, so that the urging force is applied to the movable body up to the position where the movement ends, and also, and wherein in a state where the catcher member is moved to the retracted position without catching the striker member, a forward movement of the movable body toward the position where the movement ends is allowed due to retraction of the striker axis against urging accompanied with abutting against a lateral portion of the movable body by the striker member.

* * * * *